United States Patent [19]

Cirillo

[11] Patent Number: 4,830,139

[45] Date of Patent: May 16, 1989

[54] HEARING AID HOLDING MEANS AND METHOD OF USING SAME

[76] Inventor: Evelyn J. Cirillo, 77 Coppola Terrace, Derby, Conn. 06418

[21] Appl. No.: 893,188

[22] Filed: Aug. 4, 1986

[51] Int. Cl.[4] ..... H04R 25/02

[52] U.S. Cl. ..... 181/130; 181/135; 381/68.6; 381/188

[58] Field of Search ..... 181/130, 135; 179/107 E; 128/152; 381/68, 6, 69, 187–189, 205

[56] References Cited

U.S. PATENT DOCUMENTS

| | | | |
|---|---|---|---|
| 2,538,339 | 1/1951 | Thomas | 128/152 |
| 2,824,558 | 2/1958 | Michael et al. | 181/135 X |
| 3,897,376 | 7/1975 | Lampe | 128/152 X |
| 3,975,350 | 8/1976 | Hudgins et al. | 128/127 X |
| 4,160,449 | 7/1979 | Wade | 128/152 |
| 4,552,137 | 11/1985 | Strauss | 128/152 |
| 4,696,045 | 9/1987 | Rosenthal | 381/189 X |

*Primary Examiner*—Benjamin R. Fuller
*Attorney, Agent, or Firm*—Richard A. Craig

[57] ABSTRACT

Means for holding a hearing aid speaker in place in the inner portion of the outer ear of a hearing aid user comprises a sealant material conformable both to the inner portion of the outer ear and to the speaker. The holding means also includes a pad that carries the sealant material. The sealant material is flexible, of low grade, water soluble and non-toxic. Objectionable feed-back is eliminated.

7 Claims, 1 Drawing Sheet

HEARING AID HOLDING MEANS AND METHOD OF USING SAME

BACKGROUND OF THE INVENTION

The present invention relates to hearing aid holding means and to a method of using same.

Hearing aids having speakers encased in molds are commonly used. The speaker is inserted in the inner portion of the outer ear.

Hearing aid users are well acquainted with the "feed-back" phenomenon which occurs when the mold shifts from its intended position.

This movement results in a change in the impedance of the hearing aid, and brings about whistling or ringing in the ear, commonly called feed-back. In addition to defeating the intended purpose of the hearing aid, feed-back is disconcerting and can be devastating, particularly for a hearing aid user who must use a hearing aid in each ear.

The main object of the invention is to provide holding means comprising a sealant material that can be used to hold a hearing aid speaker in place in the ear, thereby eliminating feed-back.

Another object is to provide such means which further includes a pad that carries the sealant material.

A further object is to provide such means wherein the sealant material is flexible, hydrophilic and non-toxic.

An additional object is to provide such means which is economical, simple to use and comfortable and effective in operation.

A still further object is to provide a simple method of immobilizing the speaker of a hearing aid in a predetermined position in the inner portion of an outer ear of a hearing aid user.

The above and other objects and advantages will become apparent hereinafter.

A patentability search has revealed the following U.S. patents which seem irrelevant to the invention:

| U.S. Pat. No. | Date | Inventor |
|---|---|---|
| 4,383,879 | May 17, 1983 | LeDu et al. |
| 4,393,080 | July 12, 1983 | Pawelchak et al. |
| 4,499,251 | February 12, 1985 | Omura et al. |
| 4,551,490 | November 5, 1985 | Doyle et al. |

SUMMARY OF THE INVENTION

The inventive means for holding a hearing aid speaker in place in the inner portion of the outer ear of a hearing aid user comprises a sealant material that is conformable both to the inner portion of the outer ear and to the speaker. Preferably the holding means also includes a pad that carries the sealant material.

The sealant material is flexible, hydrophilic and non-toxic.

In use, the holding means holds the speaker in a predetermined position in the inner portion of the outer ear with the sealant material engaging both the inner portion of the outer ear and the speaker.

The inventive method of using the holding means immobilizes the speaker of a hearing aid in a predetermined position in the inner portion of an outer ear and includes the steps of conforming the sealant material of the holding means to the speaker and inserting the speaker into the ear to the predetermined position. The conforming and inserting steps can be performed in either order.

DESCRIPTION OF THE INVENTION

Figure 1:
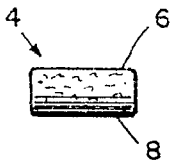
FIG. 1 is a plan view of holding means that is a preferred embodiment of the invention.

FIG. 1 shows holding means, generally indicated at 4 and comprising a rectangular pad 6 of suitable material, such as gauze or felt and carrying a sealant material 8 on both sides.

Sealant material 8 is flexible, of low grade, hydrophilic and non-toxic. Examples of compounds which are suitable for use as sealant material include natural and synthetic materials; gums including agar, carrageenan, guar gum, gum tragancath, karaya gum, pectin, xantham gum and the like as well as carboxymethylcellulose, carboxyethylcellulose, carboxypropylcellulose, poly(vinyl methyl maleate), poly(vinyl ethyl maleate), poly(vinyl butyl maleate) and the like and their alkali metal and alkaline earth metal salts, or mixtures of such materials. The above hydrophilic materials have the tendency to form polymeric and/or pseudo crosslinked structures such as gels when brought in contact with water, and they are ordinarily compounded with other materials e.g. fillers and extenders including mineral oil, petrolatum, magnesium oxide, calcium carbonate, zinc oxide, diatomaceous earth, or combination thereof. A typical combination may comprise karaya gum, mineral oil, petrolatum and magnesium oxide, or may comprise the calcium and sodium salts of poly(vinyl methyl maleate), sodium carboxymethylcellulose, petrolatum and a mineral oil. The compositions useful for the purpose of this invention may be compounded as a wettable powder, paste, cream, a liquid mixture or may be used as an impregnant for cotton, gauze, felt or other hygienically suitable absorbent containing such compositions, it being understood that none of the materials used for the purpose of this invention are detrimental to the health and wellbeing of the user. It will be assumed herein without limitation that sealant material 8 includes one or more of those compositions.

Figure 2:
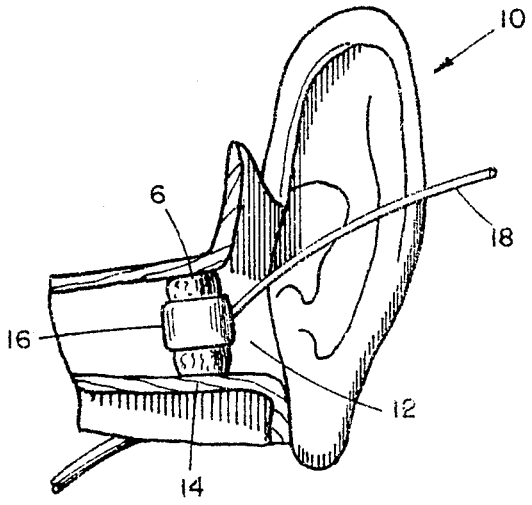
FIG. 2 is a diagrammatic view of a human ear showing a hearing aid speaker held in a predetermined position therein by the holding means of FIG. 1.

FIG. 2 shows a human ear 10 including an outer ear 12 having an inner portion 14. FIG. 2 further shows a mold 16 containing a hearing aid speaker and a wire 18 connected to the speaker, the speaker being in a predetermined position in inner portion 14 of outer ear 12.

The engagement just mentioned effectively eliminates "feed-back", thus attaining the main object of the invention.

It will be appreciated that, in using holding means 4, it is conformed to speaker mold 16 and to inner portion 14 of outer ear 12.

As used herein, the term "speaker" is broad enough to include speaker mold 16.

It should be noted also that holding means 4 could comprise sealant material 8 alone, and the same could be dispensed, as from a tube (not shown), either onto speaker mold 16 or into the ear. However, holding means 4 as described above has certain advantages thereover, among which advantages are that it is easier to control the amount of sealant material if it is carried by a pad and it is also easier to make sure that the sealant material goes to the proper place.

The invention attains the stated objects and advantages and others.

The disclosed details are exemplary only and are not to be taken as limitations on the invention except as those details may be included in the appended claims.

What is claimed is:

1. The combination of a hearing aid mold including a speaker located at a predetermined position in an inner portion of an outer ear of a user and means for holding the hearing aid mold at said predetermined position, said holding means comprising a gelatinous and water soluble sealant material in conforming engagement with the hearing aid mold and with the inner portion of the outer ear, said sealant material firmly holding said hearing aid mold at said predetermined position to prevent feedback from the speaker normally caused by shifting of said hearing aid from said predetermined position.

2. The combination of claim 1 wherein said sealant material is carried by a pad.

3. The combination according to claim 1 wherein said sealant material is flexible and hydrophilic.

4. The combination according to claim 2 wherein said sealant material is non-toxic.

5. The combination according to claim 3 wherein said sealant material includes one or more natural and synthetic gums.

6. A method of immobilizing a hearing aid mold including a speaker for preventing feedback from the speaker at a predetermined position in an inner portion of an outer ear of a user, comprising the steps of forming a holding means comprising a gelatinous and water soluble sealant material or placing in conforming engagement with the speaker hearing aid mold and inserting said speaker hearing aid mold and sealant material into said ear at said predetermined position so that said sealant material also conforms to the inner portion of the outer ear to immobilize said speaker hearing aid mold at said predetermined position and thereby eliminate feedback from said speaker normally caused by shifting positions of said speaker hearing aid mold.

7. A method according to claim 6 wherein the inserting step is performed prior to the conforming step.

* * * * *